US007337597B2

(12) United States Patent
Assirelli et al.

(10) Patent No.: US 7,337,597 B2
(45) Date of Patent: Mar. 4, 2008

(54) UNIT AND METHOD OF FEEDING CONTAINERS ARRANGED IN A NUMBER OF SUPERIMPOSED ROWS

(75) Inventors: Andrea Assirelli, Bologna (IT); Roberto Parmeggiani, Modena (IT)

(73) Assignee: G.D Societa' Perazioni, Bologna (IT)

( * ) Notice: Subject to any disclaimer, the term of this patent is extended or adjusted under 35 U.S.C. 154(b) by 0 days.

(21) Appl. No.: 11/122,306

(22) Filed: May 5, 2005

(65) Prior Publication Data

US 2006/0090423 A1 May 4, 2006

(30) Foreign Application Priority Data

Oct. 28, 2004 (IT) ..... BO2004A0671

(51) Int. Cl.
*B65B 35/50* (2006.01)

(52) U.S. Cl. ..... 53/540; 53/442; 53/447; 53/557

(58) Field of Classification Search ..... 53/53, 53/442, 447, 540, 557
See application file for complete search history.

(56) References Cited

U.S. PATENT DOCUMENTS 3,201,912 A * 8/1965 Wozniak ..... 53/495
3,657,862 A 4/1972 Milne
4,843,800 A * 7/1989 Focke ..... 53/477
4,932,190 A * 6/1990 Bergner et al. ..... 53/477
5,462,401 A 10/1995 Brizzi et al.
6,047,526 A * 4/2000 Draghetti ..... 53/443
6,158,193 A * 12/2000 Focke et al. ..... 53/53
6,511,405 B1 * 1/2003 Focke et al. ..... 493/70
6,688,077 B1 * 2/2004 Focke et al. ..... 53/234

FOREIGN PATENT DOCUMENTS

CN 510 566 A 7/1971
EP 0 635 429 A1 1/1995
EP 0 941 929 A1 9/1999
EP 1 084 954 A2 3/2001
EP 1 103 465 A1 5/2001

* cited by examiner

*Primary Examiner*—Thanh K. Truong
(74) *Attorney, Agent, or Firm*—Birch, Stewart, Kolasch & Birch, LLP

(57) ABSTRACT

A unit and method for feeding containers, whereby the containers, arranged in two superimposed rows, are fed along a horizontal path and through a reject station; upstream from the reject station, two superimposed containers are parted, by translation in a vertical direction, so as to travel, separately and facing each other, along the next portion of the path; immediately downstream from the reject station, two facing containers are brought back into contact with each other so as to travel, superimposed, along the next portion of the path; and the reject station has a first reject device for expelling only one container in a bottom row from the path, and a second reject device for expelling only one container in a top row from the path.

27 Claims, 4 Drawing Sheets

UNIT AND METHOD OF FEEDING CONTAINERS ARRANGED IN A NUMBER OF SUPERIMPOSED ROWS

The present invention relates to a unit and method of feeding containers arranged in a number of superimposed rows.

The present invention may be used to particular advantage on a cigarette packing line, to which the following description refers purely by way of example.

BACKGROUND OF THE INVENTION

A cigarette packing line normally comprises a manufacturing machine for producing the cigarettes; a filter assembly machine for applying filters to the cigarettes; a packing machine for producing soft or rigid packets of cigarettes; a cellophane machine for applying an overwrapping of transparent plastic material to the packets of cigarettes; and a cartoning machine for producing cartons for packets of cigarettes.

A feed unit is interposed between the cellophane machine and the carton machine to receive a succession of packets of cigarettes from an output of the cellophane machine and transfer the succession of packets of cigarettes to an input of the carton machine. The feed unit often has a reject station located along the path of the packets of cigarettes to remove from the path any faulty packets of cigarettes detected by control stations on the cellophane machine. Location of the reject station at the feed unit is usually advantageous on account of the considerable size of the reject station, which must also collect the rejected packets of cigarettes and is difficult to accommodate on the cellophane machine.

Some known packing lines of the type described above are designed to transfer from the output of the cellophane machine to the input of the carton machine a succession of packets of cigarettes arranged in two or more superimposed rows, so as to reduce the average travelling speed, and hence mechanical stress, of the packets of cigarettes.

When feeding packets of cigarettes arranged in two or more superimposed rows, rejection of a faulty packet of cigarettes travelling through the reject station also calls for rejecting the good packet/s stacked with it. This is due to the way in which known reject stations are built and operate, which does not permit removal from the stream of a single packet stacked with another.

The feed unit may also comprise a heat-shrink station for heat treating each packet of cigarettes. For each row of packets of cigarettes, the heat-shrink station comprises a respective channel, along which the row of packets of cigarettes travels in use, and which is bounded at the top and bottom by two slide surfaces equipped with electric heating elements. When a packet of cigarettes is pushed along the respective channel at the heat-shrink station, the major lateral walls of the packet of cigarettes inevitably slide along the heated slide surfaces, thus generating friction on the packet of cigarettes, which is a function of the pressure exerted on the packet by the slide surfaces. To avoid subjecting the packet of cigarettes to severe friction which might damage or even tear the sheet of overwrapping material, the slide surfaces are spaced far apart. Such a solution, however, reduces the effectiveness of the heat treatment and calls for using very long heat-shrink stations.

SUMMARY OF THE INVENTION

It is an object of the present invention to provide a device and method of feeding containers arranged in a number of superimposed rows, which unit and method are designed to eliminate the aforementioned drawbacks and, in particular, are inexpensive and easy to implement.

According to the present invention, there are provided a unit and method of feeding containers arranged in a number of superimposed rows, as claimed in the accompanying Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
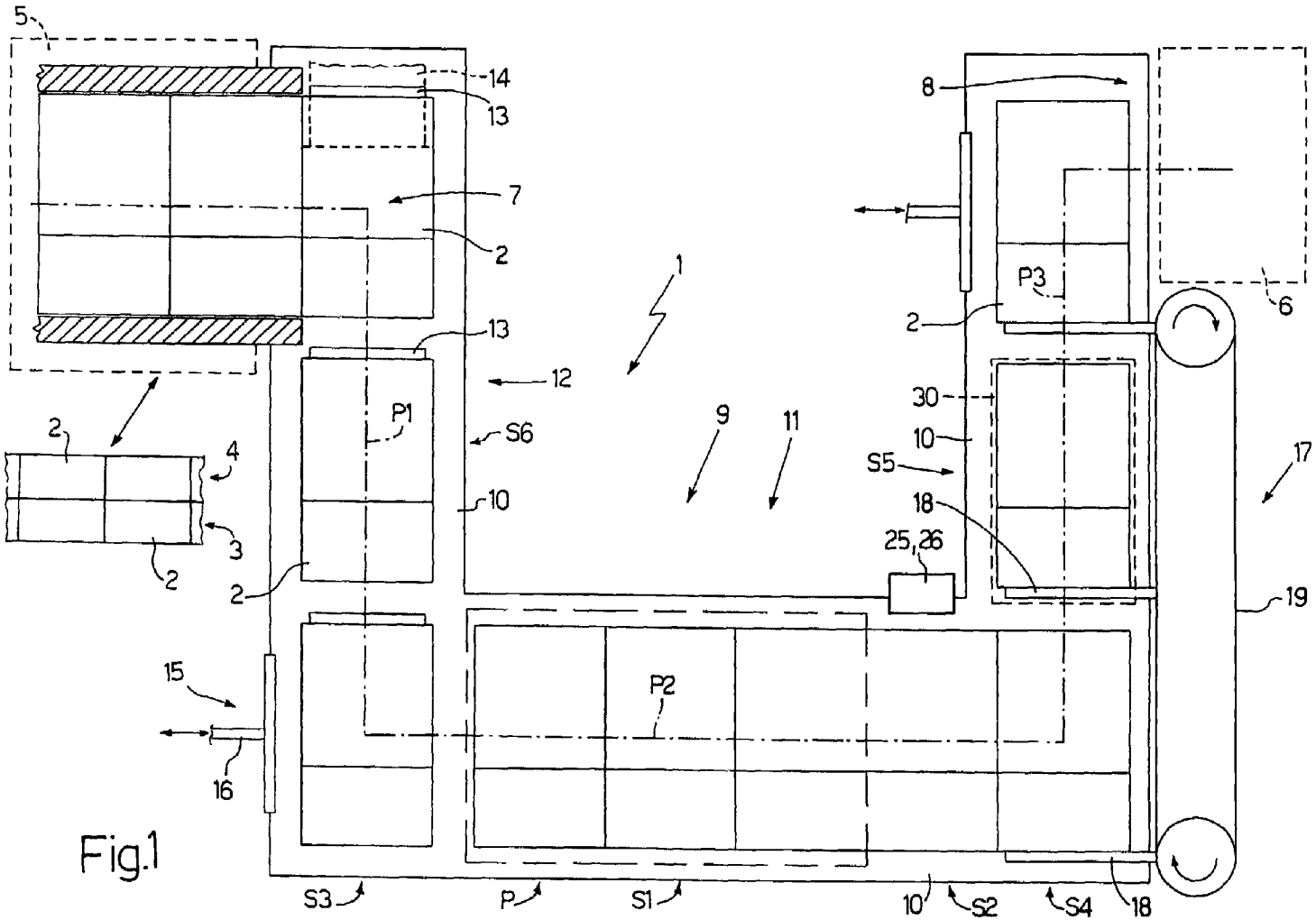
FIG. 1 shows a schematic plan view, with parts removed for clarity, of a feed unit in accordance with the present invention and located between an output of a cellophane machine and the input of a carton machine.

Number 1 in FIG. 1 indicates, as a whole, a feed unit for feeding containers or packets 2 of cigarettes arranged in two superimposed rows, i.e., bottom and top, rows 3 and 4, respectively. Feed unit 1 forms part of a cigarette packing line comprising a cellophane machine 5 for applying an overwrapping of transparent plastic material to packets 2 of cigarettes; and a carton machine 6 for producing cartons for containers 2 of cigarettes. More specifically, feed unit 1 is interposed between cellophane machine 5 and carton machine 6, receives a succession of packets 2 of cigarettes from an output 7 of the cellophane machine 5, and transfers successive packets 2 of cigarettes to an input 8 of carton machine 6.

Feed unit 1 comprises a conveying device 9 for feeding packets 2 along a horizontal U-shaped path P extending from output 7 of the cellophane machine 5 to the input 8 of carton machine 6. More specifically, path P comprises a linear start portion P1; a linear intermediate portion P2 perpendicular to start portion P1; and a linear end portion P3 parallel to start portion P1.

Conveying device 9 comprises a U-shaped slide surface 10 parallel to path P for supporting packets 2 in a sliding manner; and a push device 11 for pushing packets 2 along the slide surface 10. Push device 11 comprises a pusher 12 having a number of push members 13 fitted to an endless belt 14 (shown only partly), for pushing packets 2 along start portion P1; a pusher 15 having a push member 16 with a linear reciprocating movement, and which pushes packets 2 along intermediate portion P2; and a pusher 17 having a number of push members 18 fitted to an endless belt 19, and which pushes packets 2 along end portion P3.

Figure 2:
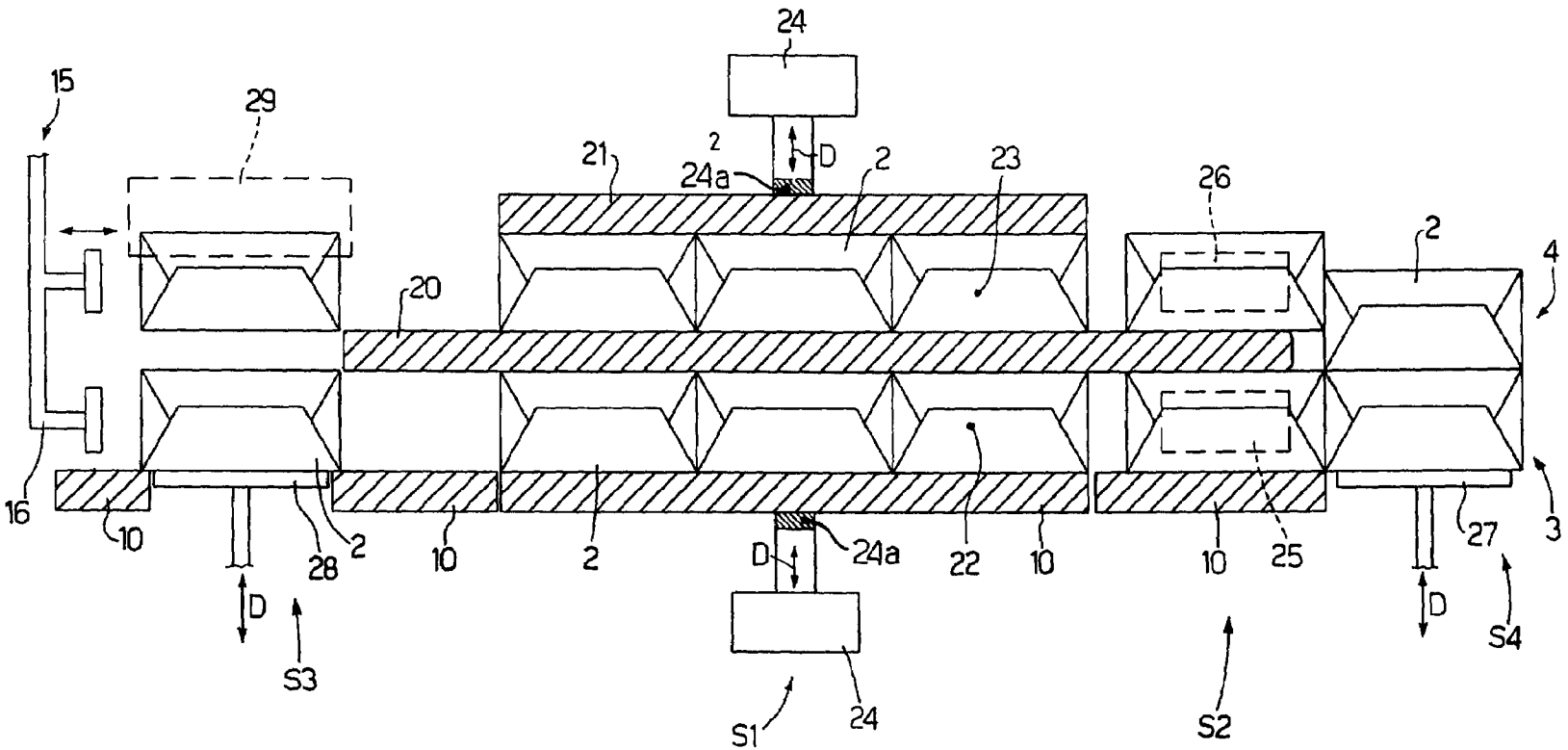
FIG. 2 shows a schematic lateral section of part of the FIG. 1 feed unit.

As shown in FIG. 2, a heat-shrink station S1, for heat treating each packet 2, and a reject station S2, for expelling any faulty packets 2 from path P, are arranged in succession along intermediate portion P2 of path P.

Upstream from heat-shrink station S1, and therefore upstream from reject station S2, is located a parting station S3 where two superimposed packets 2 are parted by translation in a vertical direction D perpendicular to path P, so as to travel separately and facing each other along the next portion of path P. Immediately downstream from reject station S2, and therefore downstream from heat-shrink station S1, is located a stacking station S4 where two facing packets 2 are brought back into contact with each other by translation in a vertical direction D, so as to travel, superimposed, along the next portion of path P.

In other words, rows 3 and 4 of packets 2 travel, superimposed, along path P with the exception of the intermediate portion P2 of path P extending between parting station S3 and stacking station S4; along which portion, rows 3 and 4 of packets 2 are conveyed separate from each other and facing each other by conveying device 9, and in particular pusher 15.

Heat-shrink station S1 further comprises two slide surfaces 20 and 21, which are parallel to and face slide surface 10 to define, with slide surface 10, two channels 22 and 23, along which respective rows 3 and 4 of packets 2 are fed. More specifically, the bottom row 3 of packets slides along slide surface 10 and inside channel 22 defined between slide surface 10 and slide surface 20, while the top row 4 of packets slides along slide surface 20 and inside channel 23 defined between slide surface 20 and slide surface 21.

Slide surfaces 10, 20, and 21 contain electrical heating elements (not shown), which are embedded inside slide surfaces 10, 20, 21 and are controlled to heat channels 22, 23 to a given temperature, which normally depends on the travelling speed of packets 2 along path P, and on the type of plastic overwrapping material (not shown) applied to packets 2.

In a preferred embodiment, slide surfaces 10 and 21 at heat-shrink station S1 are movable in a vertical direction D, perpendicular to path P, and heat-shrink station S1 comprises two actuating devices 24 for moving slide surfaces 10 and 21 cyclically in a vertical direction D perpendicular to path P, so as to move slide surfaces 10 and 21 cyclically towards and away from slide surface 20. In a preferred embodiment, both actuating devices 24 form part of the same mechanism, i.e., are powered by a common motor. In an alternative embodiment, the two actuating devices 24 are mechanically independent.

More specifically, conveying device 9 feeds packets 2 along path P with an intermittent movement comprising a cyclic succession of travelling steps and hold steps. And actuating devices 24 are timed with conveying device 9 to keep slide surfaces 10 and 21 close to slide surface 20 during the hold steps, and away from slide surface 20 during the travelling steps in the intermittent movement. This has the dual effect of permitting unimpeded travel of packets 2 along path P, and increasing heat transmission to packets 2 by virtue of sliding surfaces 10, 20, 21 firmly contacting packets 2.

The actual size of packets 2 varies fairly widely because of inevitable tolerances with regards to both materials and packing processes. Between each actuating device 24 and respective slide surface 10, 21, an elastic member 24*a* is preferably interposed to allow a certain amount of flexible self-adjustment of the position of slide surfaces 10, 21 in the vertical direction D. This is particularly useful by enabling slide surfaces 10 and 21 to adapt automatically to the actual size of packets 2.

In other words, by means of elastic members 24*a*, substantially constant pressure is applied on each packet 2 regardless of the actual size of packet 2.

By way of example, each elastic member 24*a* interposed between each actuating device 24 and respective slide surfaces 10, 21 is defined by a spring, a pneumatic shock absorber, or an elastomer.

Reject station S2 comprises a reject device 25 for expelling only one bottom packet 2, i.e., in bottom row 3 of packets 2, from path P; and a reject device 26 for expelling only one top packet 2, i.e., in top row 4 of packets 2, from path P. Each reject device 25, 26 preferably comprises a pneumatic push device (not shown in detail) for pushing a packet 2 off path P in a horizontal direction perpendicular to path P.

Slide surface 20 ends at stacking station S4, so that the packets 2 in top row 4 travelling along slide surface 20 are eventually unsupported from underneath and thus drop by the force of gravity onto packets 2 in bottom row 3. In the event a packet 2 in bottom row 3 is expelled at reject station S2, the corresponding packet 2 in the top row 4 would have too far to fall at stacking station S4 and may become misaligned, so stacking station S4 is provided with a supporting surface 27 movable, in a vertical direction D perpendicular to path P, between a withdrawn position, in which a top face of supporting surface 27 is aligned with a top face of slide surface 10, and a raised position, in which the top face of supporting surface 27 is raised with respect to the top face of slide surface 10.

When a packet 2 in bottom row 3 and a corresponding packet 2 in top row 4 are both present, supporting surface 27 is maintained in the withdrawn position, and, at the end of slide surface 20, packet 2 in top row 4 drops a short distance vertically onto packet 2 in bottom row 3. When only a packet 2 in top row 4 is present, with no corresponding packet 2 in bottom row 3, supporting surface 27 is moved into the raised position to break the free fall of packet 2 in the top row 4 and guide packet 2 down in a controlled manner as supporting surface 27 moves back down into the withdrawn position.

Parting station S3 comprises a supporting surface 28 movable, in a vertical direction D perpendicular to path P, between a withdrawn position, in which a top face of supporting surface 28 is aligned with a top face of slide surface 10, and a raised position, in which the top face of supporting surface 28 is raised with respect to the top face of slide surface 10 and aligned with a top face of slide surface 20. Parting station S3 also comprises a clamping device 29 aligned vertically with supporting surface 28 for clamping a packet 2 in a given vertical position slightly above slide surface 20. In one embodiment, clamping device 29 comprises a suction member (not shown). In an alternative embodiment, clamping device 29 comprises a gripper (not shown) having two jaws movable in a direction crosswise to path P and in opposition to elastic means.

Figure 5:
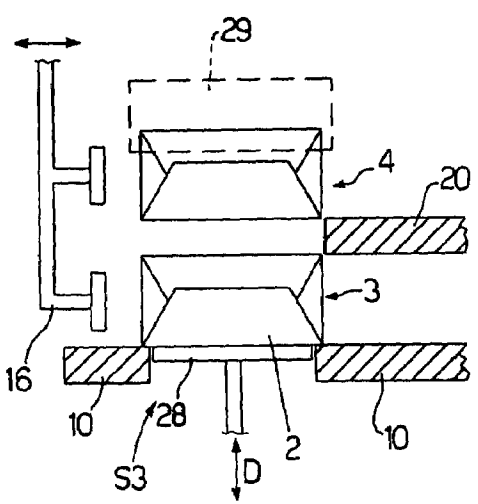
FIGS. 3 to 5 show schematic lateral sections of three sequences in the operation of a parting station of the FIG. 1 feed unit.
Figure 4:
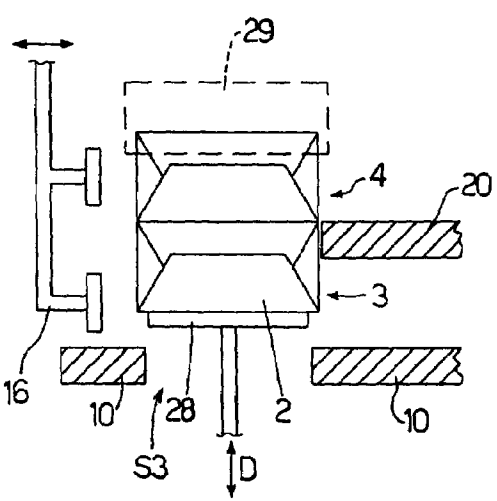
Figure 3:
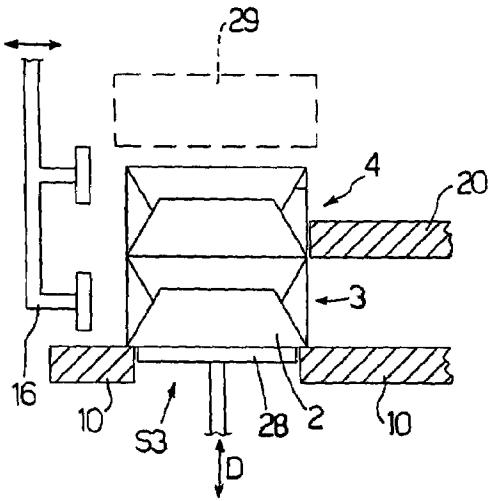

In actual use, and as shown in FIGS. 3 to 5, when a packet 2 in bottom row 3 and a corresponding packet 2 in top row 4 reach parting station S3, supporting surface 28 is moved from the withdrawn to the raised position to lift both packet 2 in bottom row 3 and corresponding packet 2 in top row 4 and bring packet 2 in top row 4 into contact with clamping device 29. At this point, packet 2 in top row 4 remains in contact with clamping device 29, and, as supporting surface 28 moves back down into the withdrawn position, is separated from packet 2 in bottom row 3 (resting on supporting surface 28).

As shown in FIG. 1, a known filler station S5 is located downstream from reject station S2 to transfer a number of packets 2 to conveying device 9 to replace any packets 2 expelled at reject station S2. Filler station S5 comprises a vertical hopper 30 containing a stack of superimposed packets 2 and having an outlet located over conveying device 9.

Figure 6:
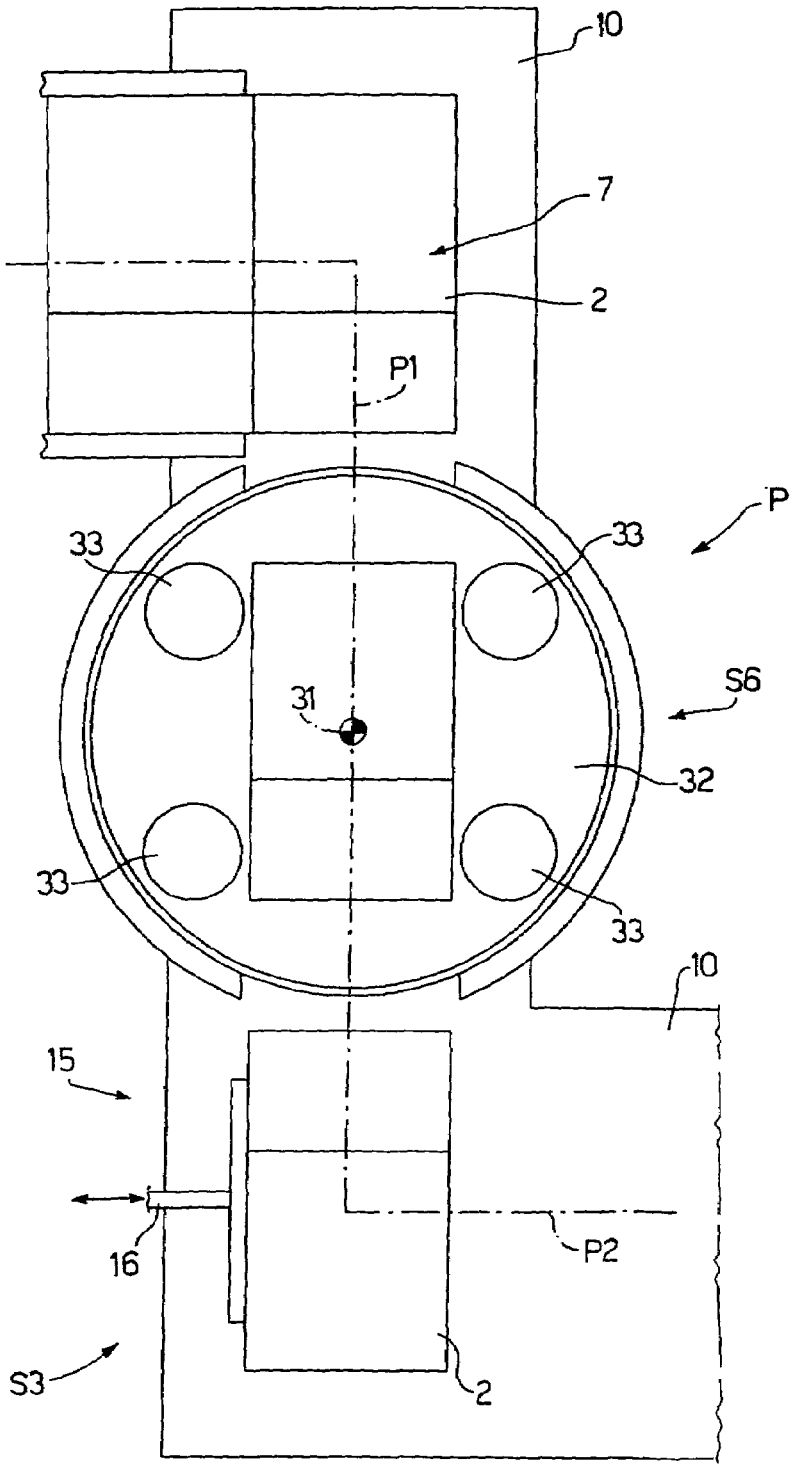
FIG. 6 shows a schematic plan view of a rotation station of the FIG. 1 feed unit.

As shown in FIG. 6, conveying device 9 preferably comprises a rotation station S6 for rotating each packet 2 by 180° about a vertical axis 31 perpendicular to path P. Rotation station S6 comprises a horizontal turntable 32 having four vertical members 33 projecting upwards from turntable 32 and arranged to enclose packets 2.

Reject station S2 as described above has numerous advantages by enabling, even in the case of packets of cigarettes arranged in two or more superimposed rows, rejection of either all or only one of the packets in a given stack, regardless of the location of the rejected packet.

Heat-shrink station S1 as described above has numerous advantages by permitting unimpeded travel of packets 2 along path P, while at the same time increasing heat transmission to packets 2 by virtue of slide surfaces 10, 20, 21 firmly contacting packets 2.

Given its numerous advantages, feed unit 1 as described above may also be used to advantage at other points along a cigarette packing line, or even on other automatic machines for packing other than cigarettes (e.g., food products).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A unit for feeding containers arranged in a number of superimposed rows which comprises conveying means for conveying the containers, arranged in at least two superimposed rows, along a horizontal path (P), a reject station (S2) for removing any faulty containers from the path (P);

a parting station (S3) located upstream from the reject station (S2) where two superimposed containers are separated from each other by translation in a vertical direction (D) perpendicular to the path (P), so as to travel separately while facing each other along the next portion of the path (P);

a stacking station (S4) located downstream from the reject station (S2) where the two facing containers are brought back into contact with each other so as to travel, superimposed, along the next portion of the path (P); said conveying means introducing the two rows of containers separately and facing each other between the parting station (S3) and the stacking station (S4); and the reject station (S2) includes a first reject device for expelling only one container from a bottom row from the path (P), and a second reject device for expelling only one container in a top row from the path (P);

wherein the conveying means comprise a first slide surface parallel to the path (P) for supporting the containers in a sliding manner, and a pusher for pushing the two rows of containers so that the containers slide along the first slide surface between the parting station (S3) and the stacking station (S4), said conveying means including a second slide surface; disposed substantially parallel to and facing the first slide surface, so that a bottom row of containers slides along the first slide surface, and a top row of containers slides along the second slide surface;

and wherein the parting station (S3) comprises a second supporting surface movable, in a vertical direction (D) perpendicular to the path (P), between a withdrawn position wherein a top face of the second supporting surface is aligned with a top face of the first slide surface, and a raised position wherein the top face of the second supporting surface is raised with respect to the top face of the first slide surface and aligned with a top face of the second slide surface.

2. The unit as claimed in claim 1, wherein the stacking station (S4) is located immediately downstream from the reject station (S2).

3. The unit as claimed in claim 1, wherein the second slide surface ends at the stacking station (S4).

4. The unit as claimed in claim 3, wherein the stacking station (S4) comprises a first supporting surface movable in a vertical direction (D) perpendicular to the path (P), between a withdrawn position where a top face of the first supporting surface is aligned with a top face of the first slide surface, and a raised position where the top face of the first supporting surface is raised with respect to the top face of the first slide surface.

5. The unit as claimed in claim 1, wherein the parting station (S3) comprises a clamping device aligned vertically with the second supporting surface for clamping a container in a given vertical position slightly above the second slide surface.

6. The unit as claimed in claim 1, wherein each reject device comprises a push device for pushing a container in a horizontal direction substantially perpendicular to the path (P).

7. The unit as claimed in claim 6, wherein each push device is a pneumatic push device.

8. The unit as claimed in claim 1, wherein a heat-shrink station (S1) is located between the parting station (S3) and the stacking station (S4) to heat treat each container.

9. The unit as claimed in claim 8, wherein the heat-shrink station (S1) comprises a first slide surface disposed parallel to the path (P) and for supporting in a sliding manner, the containers in a bottom row; a second slide surface disposed parallel to and facing the first slide surface and for supporting in a sliding manner the containers in a top row; and a third slide surface disposed parallel to and facing the second slide surface, a first heated channel, along which the bottom row of the containers travels, disposed between the first slide surface and the second slide surface; and a second heated channel, along which the top row of containers travels, disposed between the second slide surface and the third slide surface.

10. The unit as claimed in claim 9, wherein the slide surfaces are heated.

11. The unit as claimed in claim 9, wherein the heat-shrink station (S1) comprises an actuating device for moving the first and third slide surface cyclically in a vertical direction (D) perpendicular to the path (P), so as to move the first and third slide surface cyclically towards and away from the second slide surface.

12. The unit as claimed in claim 11, wherein the conveying means introduces the containers along the path (P) with an intermittent movement comprising a cyclic succession of travelling steps and hold steps; and the actuating device is timed with the conveying means to maintain the first and third slide surfaces close to the second slide surface during the hold steps in the intermittent movement, and to keep the first and third slide surfaces away from the second slide surface during the travelling steps in the intermittent movement.

13. The unit as claimed in claim 1, wherein a filler station (S5) is located downstream from the reject station (S2) to transfer a number of containers to the conveying means to replace any containers removed at the reject station (82).

14. The unit as claimed in claim 13, wherein the filler station (S5) comprises a vertical hopper containing a stack of superimposed containers and having an outlet located over the conveying means.

15. The unit as claimed in claim 1, wherein the path (P) has a U-shaped configuration and the conveying means comprises a U-shaped slide surface disposed parallel to the path (P) and for supporting the containers in a sliding manner, and push means for pushing the containers along the slide surface.

16. The unit as claimed in claim 15, wherein the push means comprises a first pusher defined by a number of push members carried by an endless first belt; a second pusher defined by a piston with a linear reciprocating movement; and a third pusher defined by a number of push members carried by an endless second belt.

17. The unit as claimed in claim 1, wherein the conveying means comprises a rotation station (S6) for rotating each container by 180° about a vertical axis, perpendicular to the path (P).

18. The unit as claimed in claim 17, wherein the rotation station (S6) comprises a horizontal turntable having four vertical members projecting upwards from the turntable and arranged to enclose the containers.

19. A unit for feeding containers arranged in a number of superimposed rows which comprises:

conveying means for conveying the containers arranged in at least two superimposed rows, along a horizontal path (P);

a reject station (S2) for removing any faulty containers from the path (P);

a parting station (S3) located upstream from the rejection station (S2) where two superimposed containers are separated from each other by translation in a vertical direction (D), perpendicular to the path (P), so as to travel separately while facing each other along the next portion of the path (P);

a stacking station (S4) located downstream from the reject station (S2) where the two facing containers are brought back into contact with each other so as to travel, superimposed, along the next portion of the path (P);

said conveying means introducing the two rows of containers separately and facing each other between the parting station (S3) and the stacking station (S4); and the reject station (S2) includes a first reject device for expelling only one container from a bottom row from the path (P), and a second reject device for expelling only one container in a top row from the path (P); wherein the conveying means comprise a first slide surface parallel to the path (P) for supporting the containers in a sliding manner, and a pusher for pushing the two rows of containers so that the containers slide along the first slide surface between the parting station (S3) and the stacking station (S4), said conveying means including a second slide surface disposed substantially parallel to and facing the first slide surface, so that a bottom row of containers slides along the first slide surface, and a top row of containers slides along the second slide surface;

and wherein the stacking station (S4) comprises a first supporting surface movable in a vertical direction (D) perpendicular to the path (P), between a withdrawn position where a top face of the first supporting surface is aligned with a top face of the first slide surface, and a raised position where the top face of the first supporting surface is raised with respect to the top face of the first slide surface.

20. A unit for feeding containers arranged in a number of superimposed rows which comprises:

conveying means for conveying the containers, arranged in at least two superimposed rows along a horizontal path (P);

a reject station (S2) for removing any faulty containers from the path (P);

a parting station (S3) located upstream from the reject station (S2) where two superimposed containers are separated from each other by translation in a vertical direction (D), perpendicular to the path (P), so as to travel separately while facing each other along the next portion of the path (P);

a stacking station (S4) located downstream from the reject station (S2) where the two facing containers are brought back into contact with each other so as to travel, superimposed, along the next portion of the path (P);

said conveying means introducing the two rows of containers separately and facing each other between the parting station (S3) and the stacking station (S4), and the reject station (S2) includes a first reject device for expelling only one container from a bottom row from the path (P), and a second reject device for expelling only one container in a top row from the path (P);

a heat-shrink station (S1) located between the parting station (S3) and the stacking station (S4) to heat treat each container;

said heat-shrink station (S1) comprising a first slide surface disposed parallel to the path (P) and for supporting in a sliding manner the containers in a bottom row; a second slide surface disposed parallel to and facing the first slide surface and for supporting in a sliding manner the containers in a top row; and a third slide surface disposed parallel to and facing the second slide surface; a first heated channel along with the bottom row of the containers travels disposed between the first slide surface and the second slide surface and a second heated channel along which the top row of containers travels disposed between the second slide surface and the third slide surface and wherein the heat-shrink station (S1) comprises an actuating device for moving the first and third slide-surface cyclically in a vertical direction (D) perpendicular to the path (P), so as to move the first and third slide surface cyclically towards and away from the second slide surface.

21. The unit as claimed in claim 20, wherein the conveying means conveys the containers along the path (P) with intermittent movement comprising a cyclic succession of traveling steps and holding steps, and the actuating device is timed with the conveying means to maintain the first and third slide surface close to the second slide surface during the holding steps of the intermittent movement and to maintain the first and third slide surface away from the second slide surface during the traveling steps of the intermittent movement.

22. A unit for feeding containers arranged in a number of superimposed rows which comprises conveying means for conveying the containers, arranged in at least two superimposed rows, along a horizontal path (P), a reject station (82) for removing any faulty containers from the path (P);

a parting station (83) located upstream from the reject station (S2) where two superimposed containers are separated from each other by translation in a vertical direction (D) perpendicular to the path (P), so as to travel separately while facing each other along the next portion of the path (P);

a stacking station (S4) located downstream from the reject station (S2) where the two facing containers are brought back into contact with each other so as to travel, superimposed, along the next portion of the path (P); said conveying means introducing the two rows of containers separately and facing each other between the parting station (S3) and the stacking station (S4); and the reject station (S2) includes a first reject device for expelling only one container from a bottom row from the path (P), and a second reject device for expelling only one container in a top row from the path (P);

and a filter station (S5) is located downstream from the reject station (S2) to transfer a number of containers to the conveying means to replace any containers removed at the rejection station (S2).

23. The unit as claimed in claim 22, wherein the filter station (S5) comprises a vertical hopper containing a stack of superimposed containers and having an outlet located over the conveying means.

24. A unit for feeding containers arranged in a number of superimposed rows which comprises conveying means for conveying the containers, arranged in at least two superimposed rows, along a horizontal path (P), a reject station (S2) for removing any faulty containers from the path (P);

a parting station (S3) located upstream from the reject station (S2) where two superimposed containers are separated from each other by translation in a vertical direction (D) perpendicular to the path (P), so as to travel separately while facing each other along the next portion of the path (P);

a stacking station (S4) located downstream from the reject station (S2) where the two facing containers are brought back into contact with each other so as to travel, superimposed, along the next portion of the path (P); said conveying means introducing the two rows of containers separately and facing each other between the parting station (S3) and the stacking station (S4); and the reject station (S2) includes a first reject device for expelling only one container from a bottom row from the path (P), and a second reject device for expelling only one container in a top row from the path (P);

wherein the path (P) is U-shaped, and the conveying means comprises a U-shaped slide surface parallel to the path (P) and for supporting the containers in a sliding manner, and a push means is provided for pushing the containers along the slide surface.

25. The unit as claimed in claim 24, wherein the push means comprises a first pusher defined by a number of push members carried by an endless first belt; a second pusher defined by a piston with a linear reciprocating movement; and a third pusher defined by a number of push members carried by an endless second belt.

26. A unit for feeding containers arranged in a number of superimposed rows which comprises conveying means for conveying the containers, arranged in at least two superimposed rows, along a horizontal path (P), a reject station (S2) for removing any faulty containers from the path (P);

a parting station (S3) located upstream from the reject station (S2) where two superimposed containers are separated from each other by translation in a vertical direction (D) perpendicular to the path (P), so as to travel separately while facing each other along the next portion of the path (P);

a stacking station (S4) located downstream from the reject station (S2) where the two facing containers are brought back into contact with each other so as to travel, superimposed, along the next portion of the path (P); said conveying means introducing the two rows of containers separately and facing each other between the parting station (S3) and the stacking station (S4); and the reject station (S2) includes a first reject device for expelling only one container from a bottom row from the path (P), and a second reject device for expelling only one container in a top row from the path (P);

wherein the conveying means comprises a rotation station (S6) for rotating each container by 180° about a vertical axis, perpendicular to the path (P).

27. The unit as claimed in claim 26, wherein the rotation station (S6) comprises a horizontal turntable having four vertical members projecting upwards from the turntable and arranged to enclose the containers.

* * * * *